US011585593B2

(12) United States Patent
Eom et al.

(10) Patent No.: US 11,585,593 B2
(45) Date of Patent: Feb. 21, 2023

(54) REFRIGERATOR

(71) Applicant: Samsung Electronics Co., Ltd., Suwon-si (KR)

(72) Inventors: Tae-In Eom, Suwon-si (KR); Hyun Uk Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 80 days.

(21) Appl. No.: 17/250,958

(22) PCT Filed: Sep. 27, 2019

(86) PCT No.: PCT/KR2019/012649
§ 371 (c)(1),
(2) Date: Apr. 1, 2021

(87) PCT Pub. No.: WO2020/071694
PCT Pub. Date: Apr. 9, 2020

(65) Prior Publication Data

US 2021/0356200 A1 Nov. 18, 2021

(30) Foreign Application Priority Data

Oct. 1, 2018 (KR) ..... 10-2018-0116857

(51) Int. Cl.
*F25D 25/02* (2006.01)
*A47B 88/463* (2017.01)
(Continued)

(52) U.S. Cl.
CPC ..... *F25D 25/025* (2013.01); *A47B 88/463* (2017.01); *A47B 88/467* (2017.01);
(Continued)

(58) Field of Classification Search
CPC .. F25D 25/025; F25D 2323/021; F25D 23/02; F25D 2325/021; A47B 88/463;
(Continued)

(56) References Cited

U.S. PATENT DOCUMENTS 8,201,900 B2 6/2012 Backhaus et al.
8,282,177 B1 * 10/2012 Rotter ..... A47B 88/467 312/319.1
(Continued)

FOREIGN PATENT DOCUMENTS

CN 102564024 A * 7/2012
CN 105627661 A 6/2016
(Continued)

OTHER PUBLICATIONS

International Search Report and Written Opinion of the International Searching Authority in connection with International Application No. PCT/KR2019/012649, dated Jan. 22, 2020, 9 pages.
(Continued)

*Primary Examiner* — Hanh V Tran

(57) ABSTRACT

Provided is a refrigerator having an opening/closing device with an improved structure which allows a storage box to be automatically inserted and withdrawn according to the opening and closing of a door and allows the storage box to be further pushed backward while the door is closed.
The refrigerator includes a main body, a storage chamber having a front side that is open, and provided at an inside with a storage box that is movable in a front-rear direction, a door rotatably coupled to the main body to open and close the storage chamber, and provided at a rear surface with a pusher that protrudes in a direction toward the storage chamber, and an opening and closing device provided at one side of the storage box, and formed to allow the storage box to be moved in the front and rear direction according to the opening and closing of the door, wherein the opening and
(Continued)

closing device includes a rack gear configured to move in a front and rear direction according to the opening and closing of the door, a locking member rotatably coupled to the rack gear to be locked with and released from the storage box, the locking member configured to move in the front and rear direction together with the rack gear, and a catcher configured to rotate to be caught with and released from the pusher according to the opening and closing of the door, wherein the catcher is rotated to be caught with the pusher when the door is a closed state to push the rack gear such that the rack gear is moved backward.

15 Claims, 14 Drawing Sheets

(51) Int. Cl.
*A47B 88/467* (2017.01)
*A47B 88/473* (2017.01)
*A47B 88/497* (2017.01)

(52) U.S. Cl.
CPC ..... *A47B 88/473* (2017.01); *A47B 88/497* (2017.01); *F25D 2323/021* (2013.01)

(58) Field of Classification Search
CPC ..... A47B 88/497; A47B 2210/175; A47B 88/467; A47B 88/47; A47B 88/473; A47B 2210/0075
See application file for complete search history.

(56) References Cited

U.S. PATENT DOCUMENTS

| | | | | |
|---|---|---|---|---|
| 8,764,134 | B2 * | 7/2014 | Salice | A47B 88/47 312/319.1 |
| 9,140,483 | B2 | 9/2015 | Park et al. | |
| 10,021,978 | B1 * | 7/2018 | Chen | A47B 88/47 |
| 10,582,771 | B2 * | 3/2020 | Xu | A47B 88/477 |
| 10,823,492 | B2 * | 11/2020 | Oh | A47B 96/025 |
| 11,459,811 | B2 * | 10/2022 | Bantie | A47B 88/47 |
| 2001/0054296 | A1 | 12/2001 | Kaiser | |
| 2003/0234600 | A1 * | 12/2003 | Helver | A47B 77/18 312/270.3 |
| 2010/0031468 | A1 * | 2/2010 | Tomiji | E05F 5/027 16/49 |
| 2011/0016908 | A1 * | 1/2011 | Kim | F25D 25/025 62/449 |
| 2011/0095670 | A1 | 4/2011 | Cho et al. | |
| 2013/0270989 | A1 * | 10/2013 | Park | F25D 23/00 74/89.17 |
| 2017/0135478 | A1 * | 5/2017 | Chen | A47B 88/467 |
| 2017/0265644 | A1 * | 9/2017 | Fischer | F16C 29/005 |
| 2018/0187965 | A1 * | 7/2018 | Seo | F25D 23/067 |
| 2018/0255928 | A1 * | 9/2018 | Chen | A47B 88/467 |

FOREIGN PATENT DOCUMENTS

| | | | | | |
|---|---|---|---|---|---|
| EP | 2650629 | A2 * | 10/2013 | | A47B 88/04 |
| EP | 3217130 | A1 | 9/2017 | | |
| EP | 3258196 | A2 | 12/2017 | | |
| JP | 2011250881 | A * | 12/2011 | | A47B 88/04 |
| KR | 10-2004-0056343 | A | 6/2004 | | |
| KR | 20080094353 | A * | 10/2008 | | |
| KR | 2008101335 | A * | 11/2008 | | |
| KR | 10-2009-0133004 | A | 12/2009 | | |
| KR | 10-2009-0133009 | A | 12/2009 | | |
| KR | 10-2013-0117903 | A | 10/2013 | | |
| KR | 10-2014-0121536 | A | 10/2014 | | |
| KR | 20170112654 | A * | 10/2017 | | |
| KR | 20170138321 | A * | 12/2017 | | |
| WO | 2012023721 | A1 | 2/2012 | | |
| WO | WO-2013134798 | A1 * | 9/2013 | | E05F 1/105 |
| WO | WO-2017057995 | A1 * | 4/2017 | | F16H 19/04 |

OTHER PUBLICATIONS

Supplementary European Search Report dated Sep. 30, 2021, in connection with European Application No. 19870023.9, 8 pages.

* cited by examiner

REFRIGERATOR

CROSS-REFERENCE TO RELATED APPLICATIONS

This application is a 371 National Stage of International Application No. PCT/KR2019/012649 filed Sep. 27, 2019, which claims priority to Korean Patent Application No. 10-2018-0116857 filed Oct. 1, 2018, the disclosures of which are herein incorporated by reference in their entirety.

BACKGROUND

1. Field

The disclosure relates to a refrigerator having an opening/closing device that allows a storage box to be automatically inserted and withdrawn according to opening and closing of a door.

2. Description of Related Art

A refrigerator is a home appliance that is equipped with a main body having a storage chamber, a cold air supply device provided to supply cold air to the storage chamber, and a door provided to open and close the storage chamber, and stores food in a fresh state.

The storage chamber is provided therein with a storage container for storing food, and the storage container is provided to be withdrawn out of the storage chamber or inserted into the storage chamber.

In order to withdraw the storage container out of the storage chamber, the user needs to put his/her hand deep into the storage chamber, which causes inconvenient to the user due to needing to take a burdensome gesture.

The refrigerator may employ an opening/closing device that may allow the storage container to be automatically inserted and withdrawn according to opening and closing of the door, but because the opening and closing device has a link structure, the storage box is inserted only by a sealing force that closes the door.

Accordingly, since there is no force exerted on the storage box except for the sealing force that closes the door, the sealing force of the door may have an influence when the storage box is incompletely inserted into the storage chamber.

SUMMARY

Therefore, it is an object of the disclosure to provide a refrigerator improved to simplify the structure of an opening/closing device for allowing a storage box to be automatically inserted and withdrawn according to the opening and closing of a door.

Therefore, it is another object of the disclosure to provide a refrigerator having an opening and closing device improved to further push a storage box backward in a state in which a door is closed.

According to an aspect of the present invention, there is provided a refrigerator including: a main body; a storage chamber having a front side that is open, and provided at an inside with a storage box that is movable in a front-rear direction; a door rotatably coupled to the main body to open and close the storage chamber, and provided at a rear surface with a pusher that protrudes in a direction toward the storage chamber; and an opening and closing device provided at one side of the storage box, and formed to allow the storage box to be moved in the front and rear direction according to the opening and closing of the door, wherein the opening and closing device includes: a rack gear configured to move in a front and rear direction according to the opening and closing of the door; a locking member rotatably coupled to the rack gear to be locked with and released from the storage box, the locking member configured to move in the front and rear direction together with the rack gear; and a catcher configured to rotate to be caught with and released from the pusher according to the opening and closing of the door, wherein the catcher is rotated to be caught with the pusher when the door is a closed state to push the rack gear such that the rack gear is moved backward.

The opening and closing device may further include a case configured to accommodate the rack gear and the catcher and an elastic member configured to transmit an elastic force to the rack gear and the catcher, wherein the case includes a first case adjacent to a sidewall of the storage chamber and a second case adjacent to the storage box.

The rack gear may include a first rack gear configured to come in contact with the pusher, and a second rack gear configured to move in a same direction as the first rack gear and to which the locking member is rotatably coupled.

The opening and closing device may include a pinion gear configured to be engaged with the first rack gear and the second rack gear to be rotated when the first rack gear and the second rack gear move linearly.

The pinion gear may be provided as a two-step gear including a first gear engaged with the first rack gear and a second gear engaged with the second rack gear such that the first rack gear and the second rack gear move linearly in a same direction.

The elastic member may include a first elastic member configured to transmit an elastic force to the second rack gear, and a second elastic member configured to transmit an elastic force to the catcher.

The first elastic member may have one side supported by the case and an other side supported by the second rack gear to transmit an elastic force such that the second rack gear moves forward.

The second elastic member may have one side fixed to the case and an other side fixed to the catcher to transmit an elastic force to the catcher such that the first rack gear is moved backward.

The storage box may include a locking protrusion, and the locking member may be locked with and released from the locking protrusion.

The first rack gear may include a contact portion configured to come in contact with the pusher and a protrusion portion formed to protrude from the contact portion to come in contact with the catcher, and the second rack gear may include a second rotation protrusion to which the locking member is rotatably coupled.

The catcher may include a first rotation protrusion rotatably coupled to the case, a first guide protrusion configured to guide the catcher to be rotated about the first rotation protrusion, a catching portion configured to be caught with and releasing from the pusher, a push portion configured to come in contact with the push when the door is closed so that the catcher is rotated, and a first rack gear support portion configured to supports the protrusion portion.

The locking member may include a rotation hole to which the second rotation protrusion is rotatably coupled, a second guide protrusion configured to guide the locking member to be rotated about the second rotation protrusion, and a locking groove configured to be locked with and released from the locking protrusion.

The first case may include a first guide groove formed to guide the first rack gear to move in the front and rear direction, a second guide groove formed to guide the second rack gear to move in the front and rear direction, a first guide slot to which the first rotation protrusion is rotatably coupled and which is provided as one pair of first guide slots in the first case and the second case to guide the first rotation protrusion such that the catcher moves in the front and rear direction, and a guide rail configured to guide the second guide protrusion.

The guide rail may include a first guide rail configured to guide the locking member to move linearly in the front and rear direction, and a second guide rail configured to guide the locking member to rotate about the second rotation protrusion.

The second case may include a first guide groove formed to guide the contact portion of the first rack gear to move in the front and rear direction, a second guide groove formed to guide the locking member to move in the front and rear direction, and a second guide slot formed to guide the first guide protrusion to rotate about the first rotation protrusion.

As is apparent from the above, the embodiments can improve the usability of a storage box through an opening and closing device with a simple structure.

DETAILED DESCRIPTION

Figure 1:
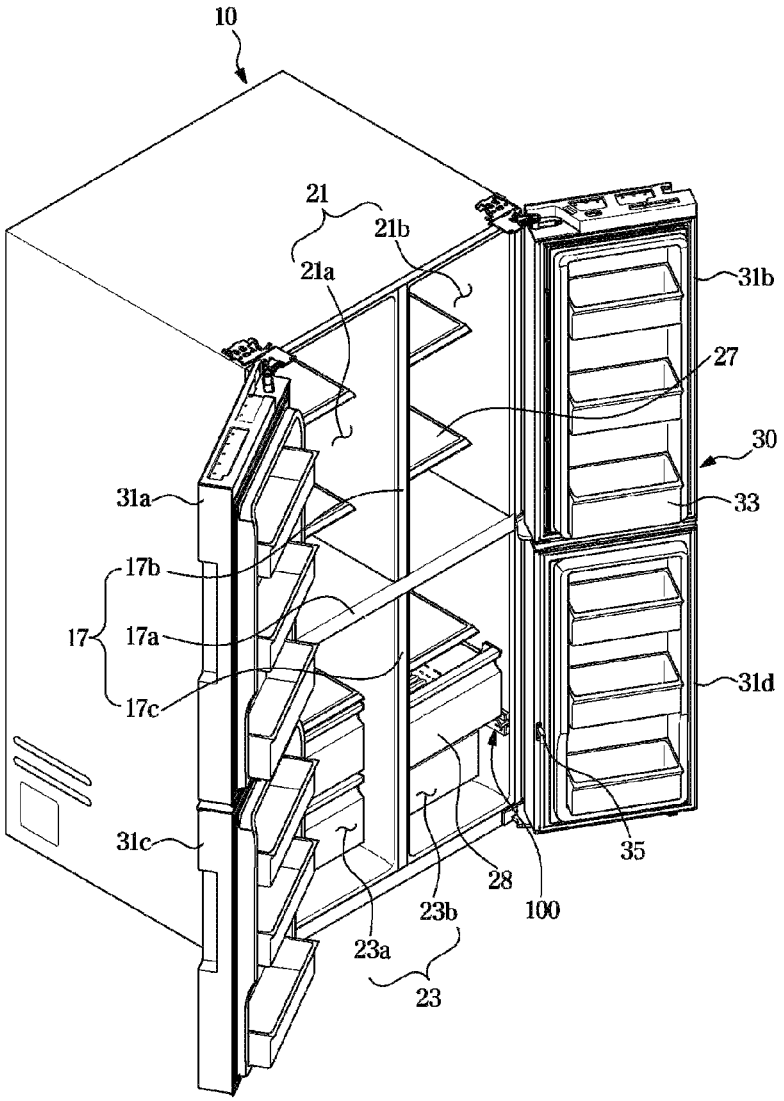
FIG. 1 is a perspective view illustrating a refrigerator according to an embodiment of the disclosure.

Embodiments and features as described and illustrated in the disclosure are only preferred examples, and various modifications thereof may also fall within the scope of the disclosure.

Throughout the drawings, like reference numerals refer to like parts or components that perform the substantially same functions.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments of the disclosure will be described in detail with reference to the accompanying drawings.

Figure 2:
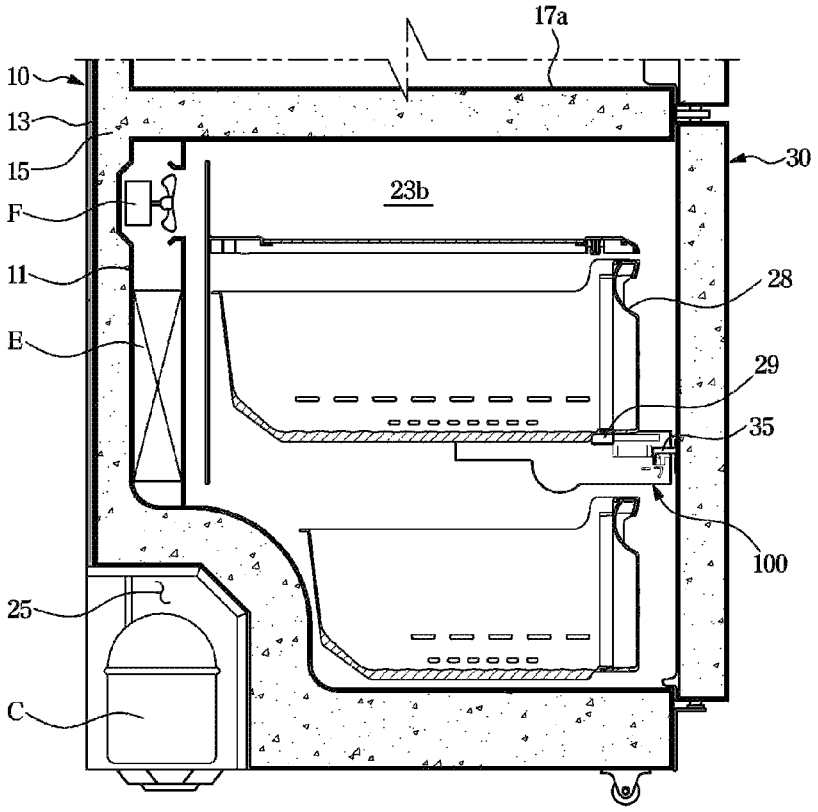
FIG. 2 is a cross-sectional view illustrating a part of a refrigerator according to an embodiment of the disclosure.

FIG. 1 is a perspective view illustrating a refrigerator according to an embodiment of the disclosure, and FIG. 2 is a cross-sectional view illustrating a part of a refrigerator according to an embodiment of the disclosure.

Referring to FIGS. 1 to 2, a refrigerator includes a main body 10 forming the external appearance thereof, a storage chamber 20 provided inside the main body 10 with a front side thereof openable and accommodating a storage box 28, a door 30 rotatably coupled to the main body 10 to open and close the open front of the storage chamber 20, and an opening and closing device 100 configured to allow the storage box 28 to be automatically inserted into and withdrawn from the storage chamber 20 according to the opening and closing of the door 30.

The main body 10 includes an inner case 11 forming the storage chamber 20 and an outer case 13 forming the external appearance thereof, and includes a cold air supply device for supplying cold air to the storage chamber 20.

The cold air supply device may include a compressor C, a condenser (not shown), an expansion valve (not shown), an evaporator E, a blowing fan F, and the like. Insulation material 15 is foamed and filled between the inner case 11 and the outer case 13 and in the interior of the door 30 to prevent the outflow of cold air from the storage chamber 20.

The storage chamber 20 is provided inside the main body 10 with a front side that is openable, and the open front side is opened and closed by the door 30.

The storage chamber 20 may be divided into a plurality of spaces by a partition wall 17.

The plurality of spaces of the storage chamber 20 divided by the partition wall 17 may include an upper storage chamber 21 and a lower storage chamber 23 that are divided by a first partition wall 17*a* coupled to the inner case 11 in the horizontal direction.

The upper storage chamber 21 may be divided into a first storage chamber 21*a* on the left side and a second storage chamber 21*b* on the right side by a second partition wall 17*b* coupled to the inner case 11 in the vertical direction.

The lower storage chamber 23 may be divided into a third storage chamber 21*c* on the left side and a fourth storage chamber 21*d* on the right side by a third partition wall 17*c* coupled to the inner case 11 in the vertical direction.

The main body 10 is provided at a lower rear side thereof with a machine room 25 in which the compressor C for compressing the refrigerant and the condenser for condensing the compressed refrigerant are installed.

The storage chamber 20 may be provided therein with a plurality of shelves 27 and the storage box 28 to store food and the like.

The storage box 28 is provided with a locking protrusion 29 on one side thereof at which the opening and closing device 100 is provided. The locking protrusion 29 is formed to protrude from the storage box 28 toward the opening and closing device 100 to be locked with the opening and closing device 100 such that the storage box 28 is moved in the front and rear direction by the opening and closing device 100.

The door 30 is rotatably coupled to the main body 10 to open and close the open front of the storage chamber 20.

The first storage chamber 21*a* and the second storage chamber 21*b* may be opened and closed by a first door 31*a* and a second door 31*b* rotatably coupled to the main body 10, respectively, and the third storage chamber 21*c* and the fourth storage chamber 21*d* may be opened and closed by a third door 31*c* and a fourth door 31*d* rotatably coupled to the main body 10, respectively.

The first door 31*a* and the second door 31*b* for opening and closing the upper storage chamber 21, and the third door 31*c* and the fourth door 31*d* for opening and closing the lower storage chamber 23 may be provided as a side-by-side door.

The door 30 may be provided at a rear surface thereof with a plurality of door guards 35 capable of storing food or the like.

In addition, the door 30 may be provided at a rear surface thereof with a pusher 35 that protrudes toward the storage chamber 20.

The pusher 35 is a component that allows the storage box 28 to move in the front and rear direction according to the opening and closing of the door 30 together with the opening and closing device 100, which will be described below. Details of the pusher 35 will be described below.

Figure 3:
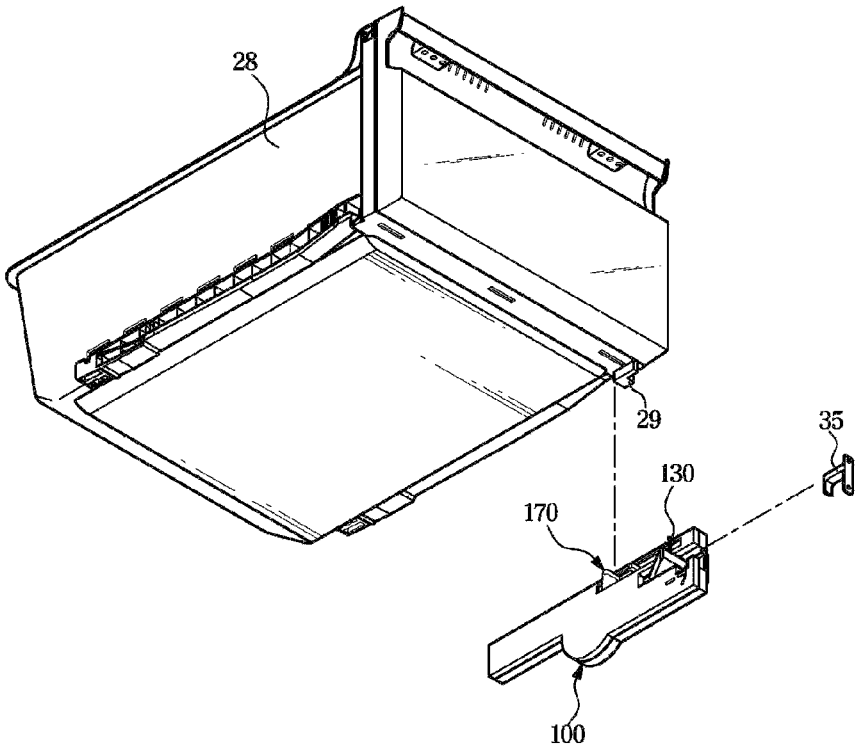
FIG. 3 is a view showing an example in which an opening and closing device is provided at one side of a storage box of a refrigerator according to an embodiment of the disclosure.
Figure 4:
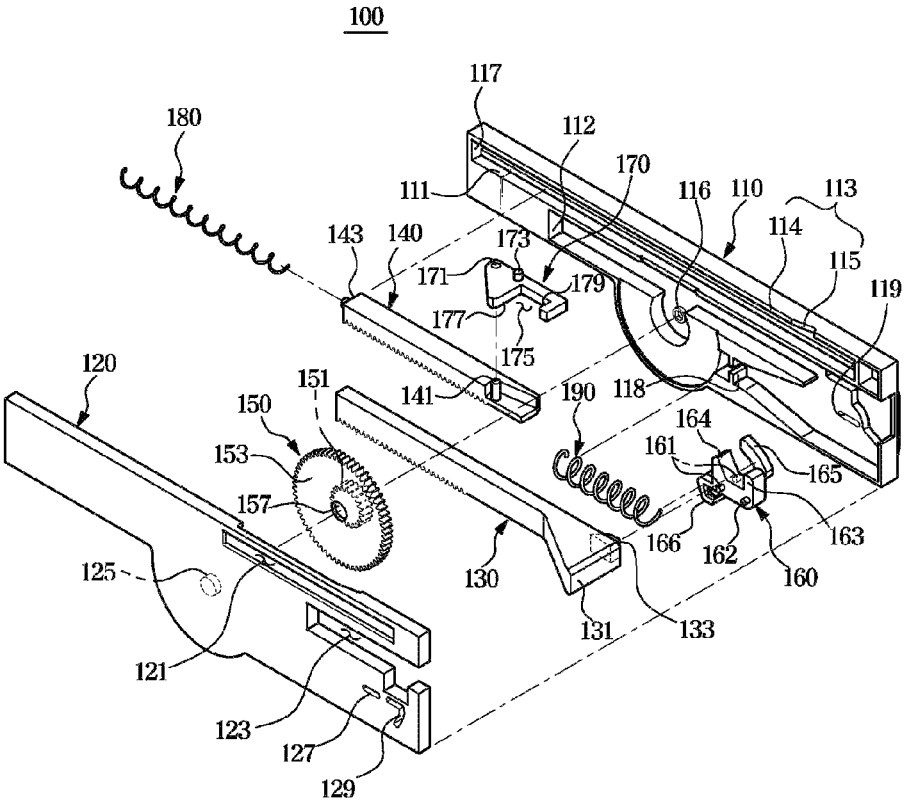
FIG. 4 is an exploded perspective view illustrating an opening and closing device according to an embodiment of the disclosure.
Figure 5:
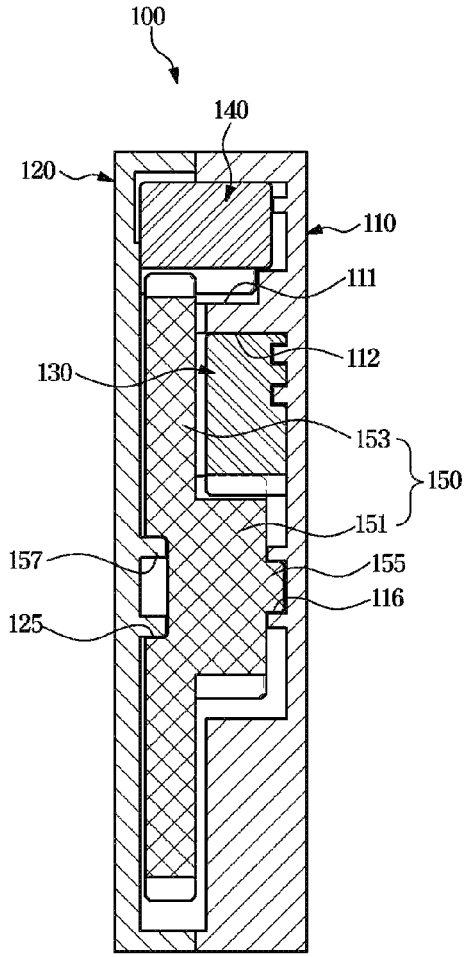
FIG. 5 is a cross-sectional view illustrating a rack gear and a pinion gear of an opening and closing device according to an embodiment of the disclosure.

FIG. 3 is a view showing an example in which an opening and closing device is provided at one side of a storage box of a refrigerator according to an embodiment of the disclosure, FIG. 4 is an exploded perspective view illustrating an opening and closing device according to an embodiment of the disclosure, and FIG. 5 is a cross-sectional view illustrating a rack gear and a pinion gear of an opening and closing device according to an embodiment of the disclosure.

Referring to FIGS. 3 to 5, the opening and closing device 100 may be provided at one side of the storage box 28 such that the storage box 28 is moved in the front-rear direction according to the opening and closing of the door 30.

In the drawing, the direction in which the storage box 28 is withdrawn out of the storage chamber 20 is referred to as a direction in which the storage box 28 is moved forward, that is, a forward direction, and the direction in which the storage box 28 is inserted into the storage chamber 20 is referred to as a direction in which the storage box 28 is moved backward, that is, a backward direction.

The opening and closing device 100 includes cases 110 and 120, rack gears 130 and 140 accommodated in the cases 110 and 120 and moved in the front and rear direction according to the opening and closing of the door 30, a pinion gear 150 engaged with the first rack gear 130 and the second rack gear 140, a catcher 160 accommodated in the cases 110 and 120 to be caught with and released from the pusher 35 of the door 30, a locking member 170 rotatably coupled to the second rack gear 140 to move in the front and rear direction together with the second rack gear 140, a first elastic member 180 for transmitting an elastic force to the second rack gear 140 such that the second rack gear 140 moves forward, and a second elastic member 190 for transmitting an elastic force to the catcher 160 such that the catcher 160 moves backward.

The cases 110 and 120 include a first case 110 adjacent to a sidewall of the storage chamber 20 and a second case 120 adjacent to the storage box 28, and accommodate all the components of the opening and closing device 100.

Details of the cases 110 and 120 will be described below.

The rack gears 130 and 140 may be provided to move in the front and rear direction according to the opening and closing of the door 30.

The rack gears 130 and 140 may include a first rack gear 130 configured to come in contact with the pusher 35 of the door 30 and a second rack gear 140 connected to the first rack gear 140 by the pinion gear 150 so as to move in the same direction as the first rack gear 140.

The first rack gear 130 may include a contact portion 131 configured to come in contact with the pusher 35 of the door 30 and a protrusion portion 133 formed to protrude from the contact portion 131 to come in contact with the catcher 160.

In a state in which the door 30 is closed, the first rack gear 130 is kept in a position moved backward while the protrusion portion 133 is supported by the catcher 160.

When the door is opened, the catcher 160 supporting the first rack gear 130 is rotated not to support the first rack gear 130 so that the first rack gear 130 may be moved forward.

When the door 30 is closed, the contact portion 131 is pushed backward by the pusher 35 of the door 30 so that the first rack gear 130 may be moved backward.

The second rack gear 140 may include a second rotation protrusion 141, to which the locking member 170 is rotatably coupled, and a second support portion 143 that supports the other side of the first elastic member 180 whose one side is supported by the first case 110.

The second rack gear 140 may be linearly moved in the same direction as the first rack gear 130 according to the opening and closing of the door 30.

The pinion gear 150 may be provided between the first rack gear 130 and the second rack gear 140 so that the first rack gear 130 and the second rack gear 140 may be engaged with the pinion gear 150.

The pinion gear 150 may be engaged with the first rack gear 130 and the second rack gear 140 to be rotated when the first rack gear 130 and the second rack gear 140 are linearly moved.

The pinion gear 150 may be provided as a two-step gear including a first gear 151 engaged with the first rack gear 130 and a second gear 153 engaged with the second rack gear 140 such that the first rack gear 130 and the second rack gear 140 are moved linearly in the same direction.

The pinion gear 150 may have a first rotation shaft 155 provided in the first gear 151 and a second rotation groove 157 provided in the second gear 153, and the first rotation shaft 155 and the second rotation groove 157 are rotatably coupled to a first rotation groove 116 of the first case 110 and a second rotation shaft 125 of the second case 120 to be described below, respectively.

The catcher 160 may be rotatably coupled to the cases 110 and 120 and rotated by the pusher 35 according to the opening and closing of the door 30.

The catcher 160 includes first rotation protrusions 161 rotatably coupled to the cases 110 and 120, a first guide protrusion 162 for guiding the catcher 160 to rotate around the first rotation protrusion 161, a catching portion 163 configured to be caught with and released from the pusher 35, a push portion 164 configured to come in contact with the pusher 35 in response to the door 30 being closed to thereby rotate the catcher 160, a first rack gear support portion 165 configured to support the protrusion portion 133 of the first rack gear 130, and a second fixing portion 166 to which the other side of the second elastic member 190 whose one side is fixed to the first case 110.

The first rotation protrusions 161 may be rotatably coupled to first guide slots 119 and 127 provided as a pair in the first case 110 and the second case 120 to be described below.

The first guide slots 119 and 127 provided as a pair in the first case 110 and the second case 120 may be formed lengthwise along the front and rear direction so that the first rotation protrusions 161 are rotatably coupled to the first guide slots 119 and 127 and provided to be moveable in the front and rear direction.

The first guide protrusion 162 may be inserted into a second guide slot 129 of the second case 120 to guide the catcher 160 such that the catcher 160 rotates around the first rotation protrusion 161.

Since the second guide slot 129 into which the first guide protrusion 162 is inserted is formed in an "L" shape, the catcher 160 once rotated may be prevented from being rotated before another force acts on the catcher 160.

The catching portion 163 may be formed at a position adjacent to the pusher 35 of the door 30, so that the catching portion 163 may be caught with the pusher 35 when the door 30 is in a closed state.

Since the catching portion 163 is given a force in the forward direction by the pusher 35 when the door 30 is opened, the catcher 160 may be rotated clockwise in the drawing around the first rotation protrusion 161.

When the catcher 160 is rotated clockwise in the drawing around the first rotation protrusion 161, the catching portion 163 may be released from the pusher 35.

Since the push portion 164 is given a force in the backward direction by the pusher 35 when the door 30 is closed, the catcher 160 may be rotated counterclockwise around the first rotation protrusion 161.

The first rack gear support portion 165 may support the protrusion portion 133 of the first rack gear 130 when the door 30 is in a closed state, so that the first rack gear 130 does not move forward.

When the door 30 is closed, the pusher 35 allows the catcher 160 to be rotated, and then pushes the contact portion 131 of the first rack gear 130, which causes the first rack gear 130 to be moved backward so that the storage box 28 is moved backward, which will be described below when describing the operation of the opening and closing device 100.

When the door 30 is closed, the contact portion 131 of the first rack gear 130 comes in contact with the pusher 35, but once the door 30 is closed, the first rotation protrusion 161 of the catcher 160 is moved backward along the first guide slots 119 and 127 of the cases 110 and 120 by the elastic force of the second elastic member 190, so that when the closing of the door 30 is completed, the protrusion portion 133 of the first rack gear 130 may be supported by the first rack gear support portion 165 of the catcher 160.

The locking member 170 may be rotatably coupled to the second rack gear 140 and moved together with the second rack gear 140 in the front and rear direction.

The locking member 170 includes a rotation hole 171 rotatably coupled to the second rotation protrusion 141 of the second rack gear 140, a second guide protrusion 173 for guiding the locking member 170 to be rotated around the second rotation protrusion 141, and a locking groove 175 caught with and released from the locking protrusion 29 of the storage box 28.

The second guide protrusion 173 may be guided along a guide rail 113 of the first case 110 to be described below, and due to the shape of the guide rail 113 to be described below, the locking member 170 may be rotated around the second rotation protrusion 141.

The locking groove 175 is kept caught with the locking protrusion 29 of the storage box 28 when the door 30 is in a closed state so that the second rack gear 140 and the storage box 28 may be moved together in the front and rear direction.

The locking groove 175 may include a first surface 177 configured to push the locking protrusion 29 when the second rack gear 140 is moved forward, and a second surface 179 configured to push the locking protrusion 29 when the second rack gear 140 is moved backward.

When the door 30 is opened and the second rack gear 140 moves forward, the first surface 177 of the locking groove 175 pushes the locking protrusion 29 so that the storage box 28 may be moved forward.

Since the locking member 170 is rotatably coupled to the second rack gear 140, the locking member 170 may be rotated around the second rotation protrusion 140 in a process of the second rack gear 140 being moved forward to thereby be released from the locking protrusion 29.

When the locking groove 175 is released from the locking protrusion 29, the storage box 28 may be moved further forward freely without restraint.

When the door 30 is closed, the locking member 170 may be rotated around the second rotation protrusion 141 again in the process of the door 30 being closed, to thereby be caught with the locking protrusion 29.

In this case, the second surface 179 of the locking groove 175 may push the locking protrusion 29 to be directed toward the rear side, so that the storage box 28 may be moved backward together with the second rack gear 140.

The first elastic member 180 may have the one side supported by the first case 110 and the other side supported by the second support portion 143 of the second rack gear 140.

The second rack gear 140 may be given an elastic force in a forward direction by the first elastic member 180.

The second elastic member 190 may have the one side fixed to the first case 110 and the other side fixed to the second fixing portion 166 of the catcher 160.

The catcher 160 may be given an elastic force in a backward direction by the second elastic member 190.

The cases 110 and 120 may include the first case 110 adjacent to the sidewall of the storage chamber 20 and the second case 120 adjacent to the storage box 28.

The first case 110 includes a first guide groove 111 formed to guide the first rack gear 130 to be moved in the front and rear direction, a second guide groove 112 formed to guide the second rack gear 140 to be moved in the front and rear direction, and a guide rail 113 formed to guide the second rotation protrusion 141 of the second rack gear 140 and the second guide protrusion 173 of the locking member 170.

The guide rail 113 may include a first guide rail 114 that guides the locking member 170 such that the locking member 170 moves in the front and rear direction, and a second guide rail 115 that guides the second guide protrusion 173 such that the locking member 170 rotates about the second rotation protrusion 141.

The locking member 170 may be rotated in a counterclockwise direction around the second rotation protrusion 141 while the second guide protrusion 173 is moving from the first guide rail 114 to the second guide rail 115. As the locking member 170 is rotated counterclockwise around the second rotation protrusion 141, the locking groove 175 may be released from the locking protrusion 29 (see FIG. 9).

The first case 110 may further include a first rotation groove 116 to which the first rotation shaft 155 of the pinion gear 150 is rotatably coupled, a first support portion 117 supported by one side of the first elastic member 180, and a first fixing portion 118 to which one side of the second elastic member 190 is fixed.

In addition, the first case 110 may include the first guide slot 119 to which the first rotation protrusion 161 of the catcher 160 is rotatably coupled and which guides the first rotation protrusion 161 to be moved in the front and rear direction.

The second case 120 may include a first guide groove 121 that guides the contact portion 131 of the first rack gear 130 to be moved in the front and rear direction and a second guide groove 123 that guides the locking member 170 to be moved in the front and rear direction.

The second case 120 may further include the second rotation shaft 125 rotatably coupled to the second rotation groove 175 of the pinion gear 150, and the second guide slot 129 that guides the first guide protrusion 162 such that the catcher 160 rotates around the first rotation protrusion 161.

Since the second guide slot 129 is formed in an "L" shape, the catcher 160 once rotated may maintain the rotated state until another force acts on the catcher 160.

The second case 120 may include the first guide slot 127 provided at a position corresponding to that of the first guide slot 119 formed in the first case 110, and the first guide slots 119 and 127 may be provided as one pair in the first case 110 and the second case 120.

Figure 6:
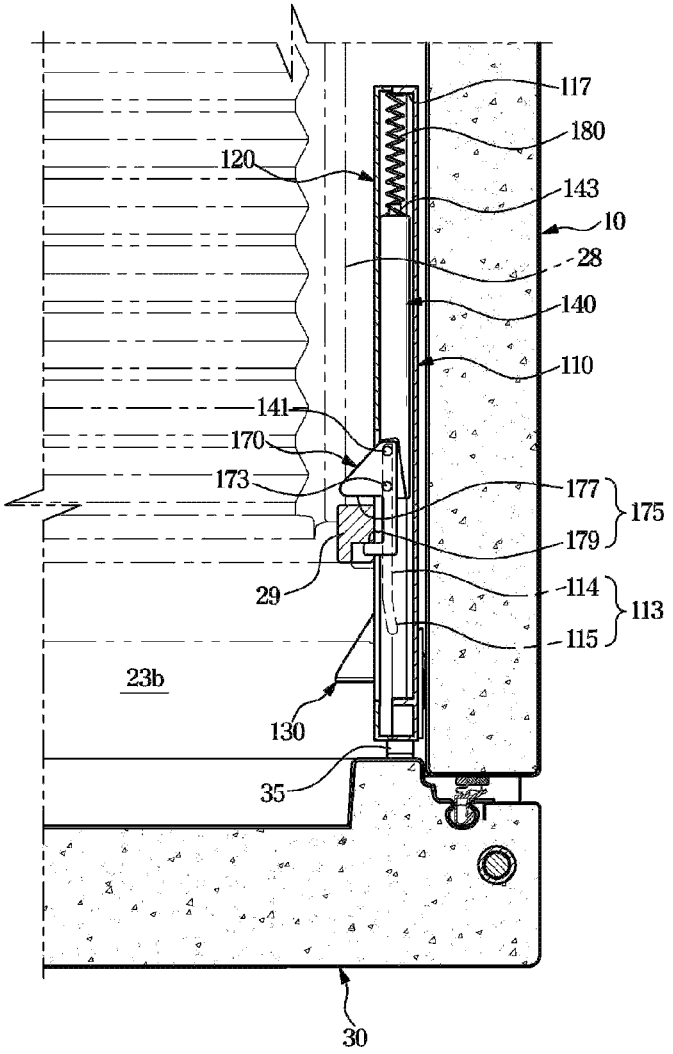
FIG. 6 is a view illustrating a storage box and an opening and closing device viewed from the above when a door of a refrigerator is closed according to an embodiment of the disclosure.
Figure 7:
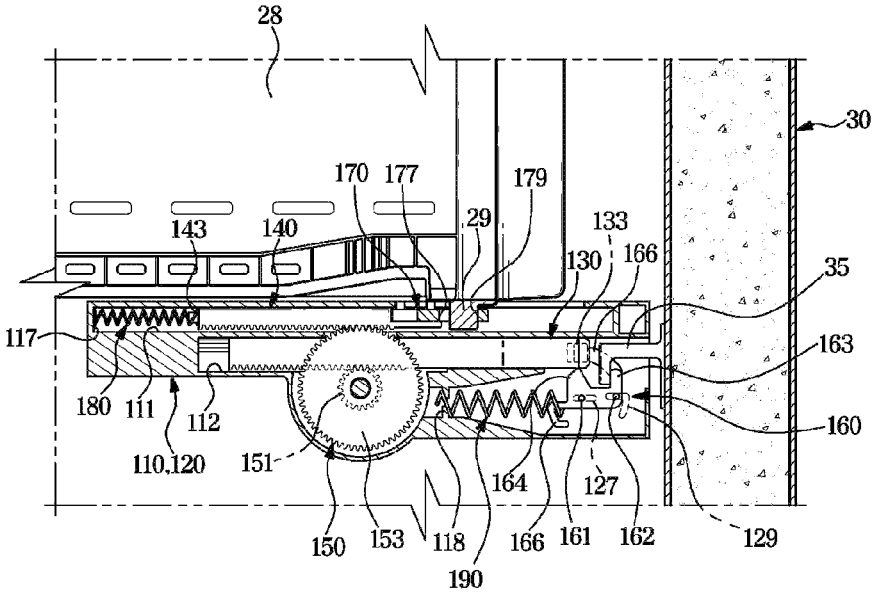
FIG. 7 is a view illustrating a storage box and an opening and closing device viewed from the side when a door of a refrigerator is closed according to an embodiment of the disclosure.
Figure 8:
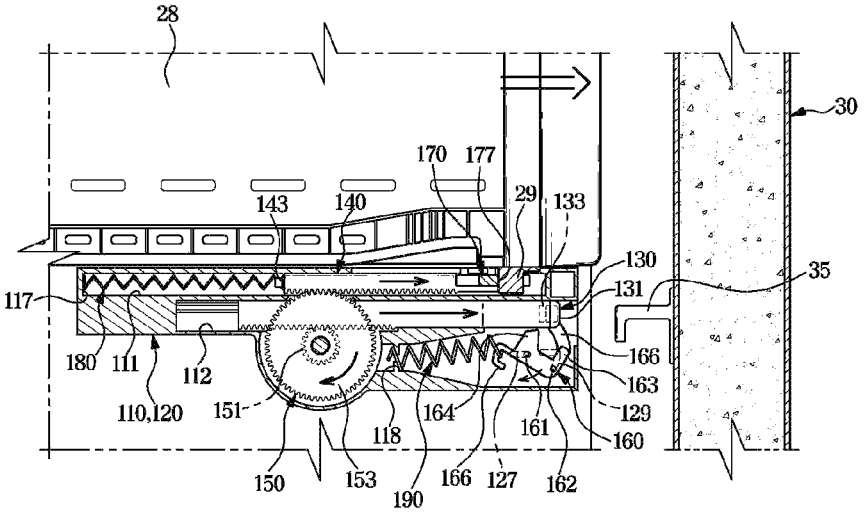
FIG. 8 is a view illustrating a process of opening a door of a refrigerator according to an embodiment, in which rotation of a catcher causes a first rack gear and a second rack gear to move forward, and a storage box is moved forward together with the first rack gear and the second rack gear.
Figure 9:
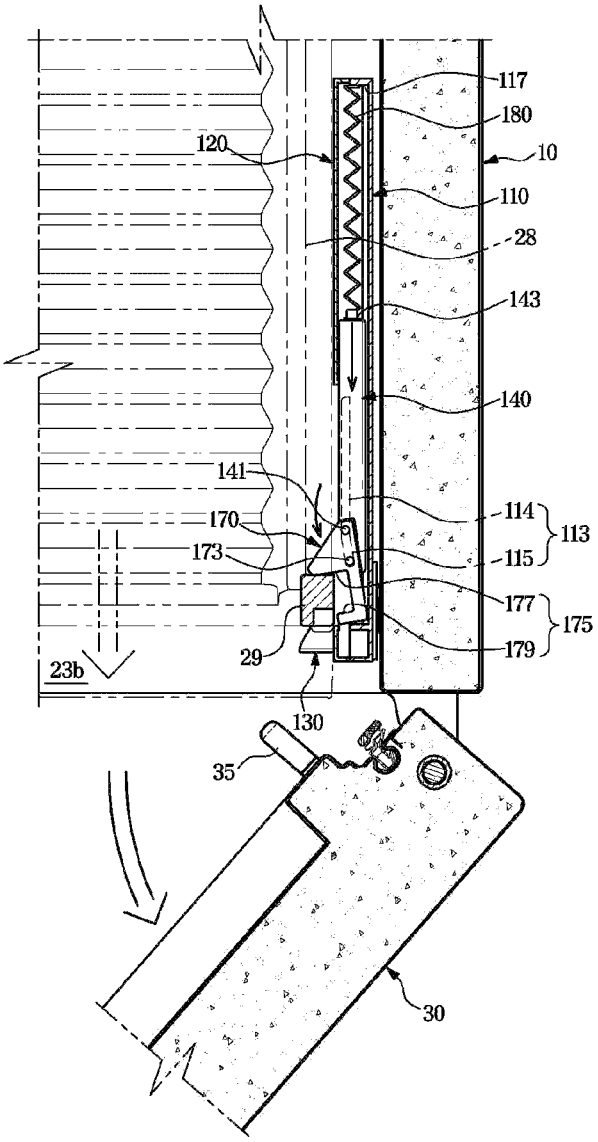
FIG. 9 is a view illustrating a process of opening a door of a refrigerator according to an embodiment of the disclosure, in which locking of a locking protrusion with a locking groove is released.
Figure 10:
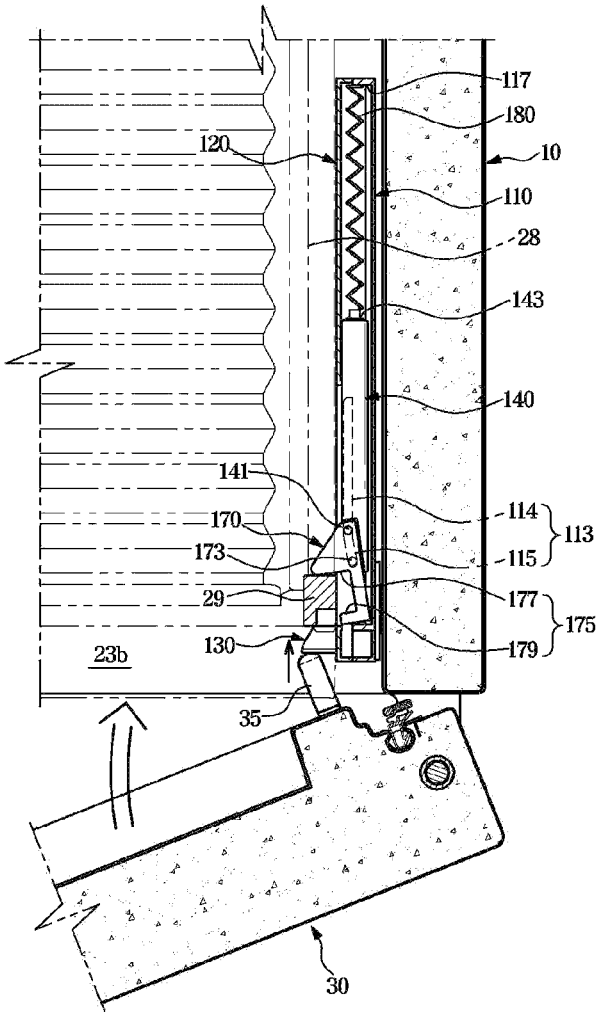
FIG. 10 is a view illustrating a process of closing a door of a refrigerator according to an embodiment of the disclosure, in which a pusher of the door is brought into contact with a contact portion of a first rack gear.
Figure 11:
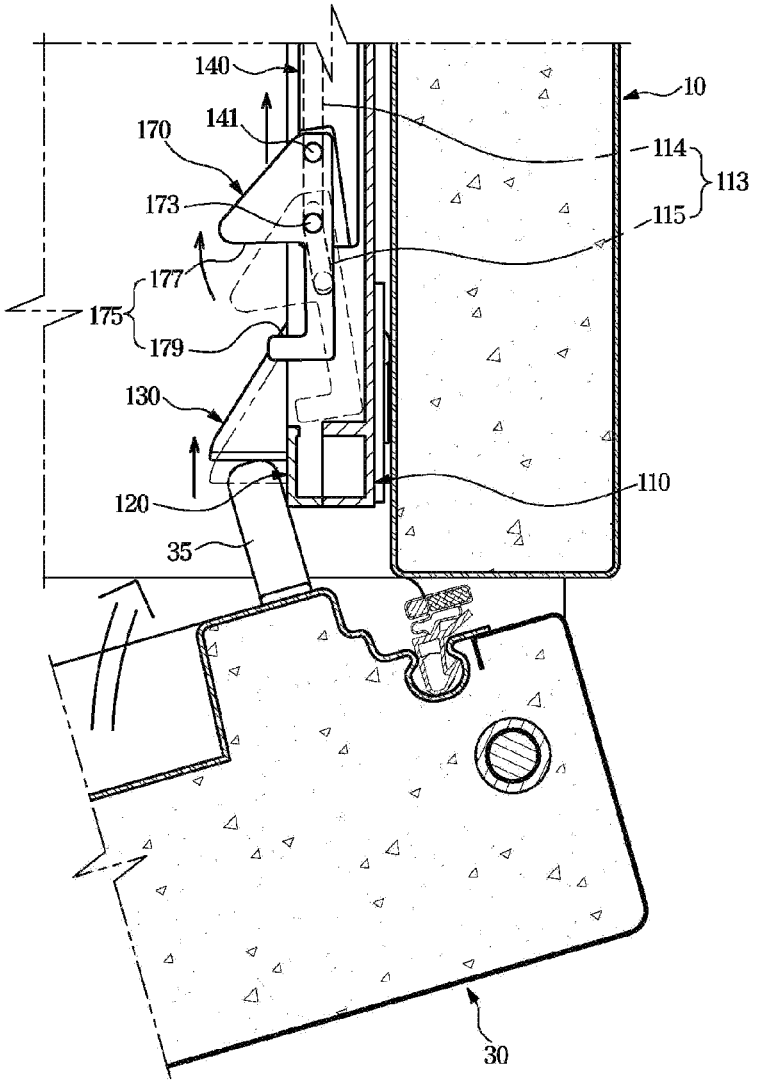
FIG. 11 is a view illustrating a process of closing a door of a refrigerator according to an embodiment of the disclosure, in which a locking member is rotated to be locked with a locking protrusion.
Figure 12:
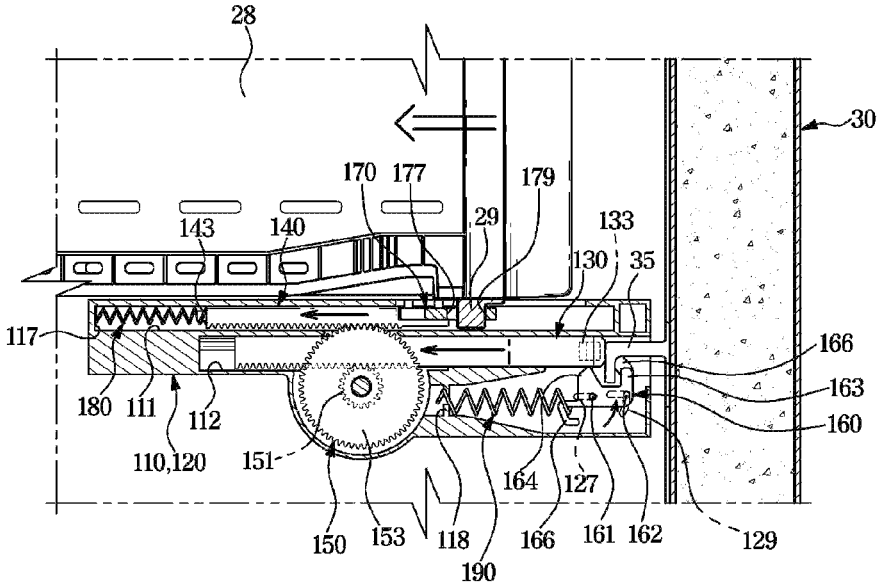
FIG. 12 is a view illustrating an operation in which a door, while being closed, causes a catcher to be rotated so that a rack gear and a storage box are moved backward.
Figure 13:
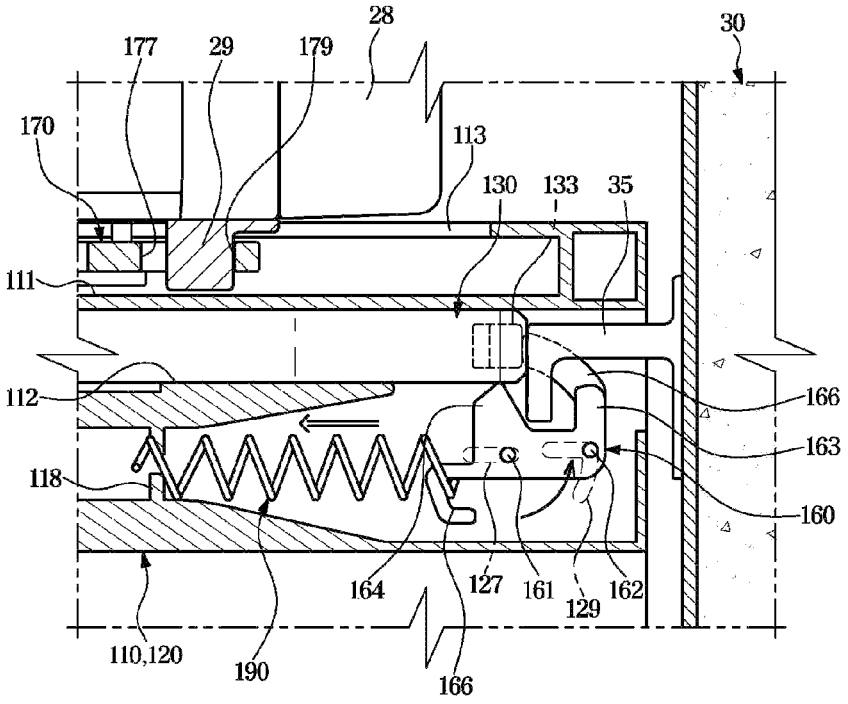
FIG. 13 is a view illustrating an operation in which a door, while being closed, causes a catcher to be rotated so that the catcher supports a protrusion portion of a first rack gear.
Figure 14:
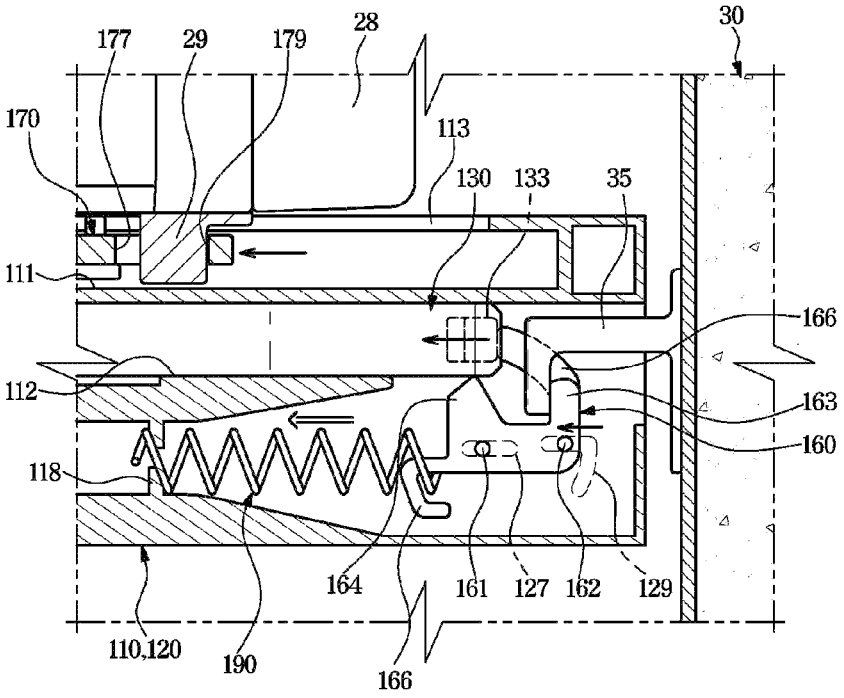
FIG. 14 is a view illustrating an operation subsequent to that of FIG. 13, in which a catcher is moved backward by an elastic force of a second elastic member to push a first rack gear backward.

Hereinafter, an operation of the storage box 28 being withdrawn out of the storage chamber 20 or inserted into the storage chamber 20 by the opening and closing device 100 when the door 30 is opened and closed will be described in detail with reference to FIGS. 6 to 15, FIG. 6 is a view illustrating a storage box and an opening and closing device viewed from the above when a door of a refrigerator is closed according to an embodiment of the disclosure, FIG. 7 is a view illustrating a storage box and an opening and closing device viewed from the side when a door of a refrigerator is closed according to an embodiment of the disclosure, FIG. 8 is a view illustrating a process of opening a door of a refrigerator according to an embodiment, in which rotation of a catcher causes a first rack gear and a second rack gear to move forward, and a storage box is moved forward together with the first rack gear and the second rack gear, FIG. 9 is a view illustrating a process of opening a door of a refrigerator according to an embodiment of the disclosure, in which locking of a locking protrusion with a locking groove is released, FIG. 10 is a view illustrating a process of closing a door of a refrigerator according to an embodiment of the disclosure, in which a pusher of the door is brought into contact with a contact portion of a first rack gear, FIG. 11 is a view illustrating a process of closing a door of a refrigerator according to an embodiment of the disclosure, in which a locking member is rotated to be locked with a locking protrusion, FIG. 12 is a view illustrating an operation in which a door, while being closed, causes a catcher to be rotated so that a rack gear and a storage box are moved backward, FIG. 13 is a view illustrating an operation in which a door, while being closed, causes a catcher to be rotated so that the catcher supports a protrusion portion of a first rack gear, and FIG. 14 is a view illustrating an operation subsequent to that of FIG. 13, in which a catcher is moved backward by an elastic force of a second elastic member to push a first rack gear backward.

Referring to FIGS. 6 to 7, when the door 30 is in a closed state, the locking groove 175 of the locking member 170 is kept locked with the locking protrusion 29 of the storage box 28

When the door 30 is a closed state, the pusher 35 of the door 30 is kept caught with the catching portion 163 of the catcher 160.

Referring to FIG. 8, when the door 30 is opened, the catcher 160 may be rotated clockwise around the first rotation protrusion 161.

When the catcher 160 is rotated, the first guide protrusion 162 may be guided along the second guide slot 129.

Since the second guide slot 129 is formed in an "L" shape, the first guide protrusion 162, once rotated clockwise along the second guide slot 129, is fixed, so that the catcher 160 is prevented from being rotated in the counterclockwise direction around the first rotation protrusion 161.

After the rotation of the catcher 160, the protrusion portion 133 of the first rack gear 130 supported by the first rack gear support portion 165 of the catcher 160 be moved forward, and the second rack gear 140 may also be moved forward together with the first rack gear 130.

When the second rack gear 140 is moved forward, the storage box 28 may be moved forward by the locking member 170 moving forward together with the second rack gear 140.

Referring to FIG. 9, when the door 30 is opened, the locking groove 175 of the locking member 170 is kept caught with the locking protrusion 29 of the storage box 28, the first surface 177 of the locking groove 175 pushes the catching protrusion 29 forward, so that the storage box 28 may be moved forward.

In the process of opening the door 30, the second rotation protrusion 141 of the second rack gear 140 and the second guide protrusion 173 of the locking member 170, by being guided along the first guide rail 114, may be moved forward, but when the second guide protrusion 173 starts to be guided along the second guide rail 115, the locking member 170 may be rotated in a counterclockwise direction around the first rotation protrusion 161.

When the locking member 170 is rotated counterclockwise around the first rotation protrusion 161, the locking groove 175 of the locking member 170 may be released from the catching protrusion 29, so that the storage box 28 may be moved forward without restraint.

Referring to FIG. 10, when the door 30 is closed, the pusher 35 of the door 30 comes in contact with the contact portion 131 of the first rack gear 130 to push the contact portion 131 backward.

Referring to FIG. 11, when the first rack gear 130 is moved forward, the second rack gear 140 may also be moved backward together with the first rack gear 130, and the locking member 170 may also be moved backward together with the second rack gear 140.

When the second guide protrusion 173 of the locking member 170 switches from moving along the second guide rail 115 to moving along the first guide rail 114, the locking member 170 may be rotated clockwise around the second rotation protrusion 141.

When the locking member 170 is rotated clockwise around the second rotation protrusion 141, the locking groove 175 of the locking member 170 may be caught with the locking protrusion 29.

Referring to FIGS. 12 and 13, the second rack gear 140 is moved backward while the locking groove 175 of the locking member 170 is caught with the locking protrusion 29, so that the storage box 28 may be moved backward.

In this case, the pusher 35 of the door 30 may push the push portion 164 of the catcher 160, so that the catcher 160 may be rotated in a counterclockwise direction around the first rotation protrusion 161.

The first rack gear 130 may be moved backward with the contact portion 131 being pushed backward by the pusher 35 of the door 30 while the protrusion portion 133 is pushed backward by the first rack gear support portion 165 of the catcher 160.

Referring to FIG. 14, in a state in which the door 30 is closed and the storage box 28 is moved backward, the catcher 160 may be moved backward by the elastic force of the second elastic member 190.

The first rotation protrusions 161 of the catcher 160 may be moved backward along the first guide slots 119 and 127, and the first guide protrusion 162 may be moved backward along the second guide slot 129.

After the first guide protrusion 162 is moved backward along the second guide slot 129, the catcher 160 may be prevented from being rotated in the opposite direction because the second guide slot 129 is formed in an "L" shape, While the catcher 160 is being moved backward by the elastic force of the second elastic member 190, the first rack gear support portion 165 of the catcher 160 moves the protrusion portion 133 of the first rack gear 130 backward, so that the storage box 28 may be moved further backward and thus may not affect the sealing force of the door 30.

In this case, since the elastic force of the second elastic member 190 is greater than the elastic force of the first elastic member 180, the catcher 160 may be moved backward by the elastic force of the second elastic member 190.

Although the air conditioner has been described by way of embodiments in relation to a specific shape and direction, the above embodiments are illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A refrigerator comprising:

a main body;

a storage chamber having a front side that is open, and provided at an inside with a storage box that is movable in a front-rear direction;

a door rotatably coupled to the main body to open and close the storage chamber, and provided at a rear surface with a pusher that protrudes in a direction toward the storage chamber; and an opening and closing device provided at one side of the storage box, and formed to allow the storage box to be moved in the front and rear direction according to the opening and closing of the door, wherein the opening and closing device includes:

a rack gear configured to move in a front and rear direction according to the opening and closing of the door;

a locking member rotatably coupled to the rack gear to be locked with and released from the storage box, the locking member configured to move in the front and rear direction together with the rack gear; and a catcher configured to rotate to be caught with and released from the pusher according to the opening and closing of the door, wherein the catcher is rotated to be caught with the pusher when the door is a closed state to push the rack gear such that the rack gear is moved backward.

2. The refrigerator of claim 1, wherein the opening and closing device further includes a case configured to accommodate the rack gear and the catcher and an elastic member configured to transmit an elastic force to the rack gear and the catcher, wherein the case includes a first case adjacent to a sidewall of the storage chamber and a second case adjacent to the storage box.

3. The refrigerator of claim 2, wherein the rack gear includes a first rack gear configured to come in contact with the pusher, and a second rack gear configured to move in a same direction as the first rack gear and to which the locking member is rotatably coupled.

4. The refrigerator of claim 3, wherein the opening and closing device includes a pinion gear configured to be engaged with the first rack gear and the second rack gear to be rotated when the first rack gear and the second rack gear move linearly.

5. The refrigerator of claim 4, wherein the pinion gear is provided as a two-step gear including a first gear engaged with the first rack gear and a second gear engaged with the second rack gear such that the first rack gear and the second rack gear move linearly in a same direction.

6. The refrigerator of claim 5, wherein the elastic member includes a first elastic member configured to transmit an elastic force to the second rack gear, and a second elastic member configured to transmit an elastic force to the catcher.

7. The refrigerator of claim 6, wherein the first elastic member has one side supported by the case and an other side supported by the second rack gear to transmit an elastic force such that the second rack gear moves forward.

8. The refrigerator of claim 7, wherein the second elastic member has one side fixed to the case and an other side fixed to the catcher to transmit an elastic force to the catcher such that the first rack gear is moved backward.

9. The refrigerator of claim 8, wherein the storage box includes a locking protrusion, and the locking member is locked with and released from the locking protrusion.

10. The refrigerator of claim 9, wherein the first rack gear includes a contact portion configured to come in contact with the pusher and a protrusion portion formed to protrude from the contact portion to come in contact with the catcher, and the second rack gear includes a second rotation protrusion to which the locking member is rotatably coupled.

11. The refrigerator of claim 10, wherein the catcher includes a first rotation protrusion rotatably coupled to the case, a first guide protrusion configured to guide the catcher to be rotated about the first rotation protrusion, a catching portion configured to be caught with and releasing from the pusher, a push portion configured to come in contact with the push when the door is closed so that the catcher is rotated, and a first rack gear support portion configured to supports the protrusion portion.

12. The refrigerator of claim 11, wherein the locking member includes a rotation hole to which the second rotation protrusion is rotatably coupled, a second guide protrusion configured to guide the locking member to be rotated about the second rotation protrusion, and a locking groove configured to be locked with and released from the locking protrusion.

13. The refrigerator of claim 12, wherein the first case includes a first guide groove formed to guide the first rack gear to move in the front and rear direction, a second guide groove formed to guide the second rack gear to move in the front and rear direction, a first guide slot to which the first rotation protrusion is rotatably coupled and which is provided as one pair of first guide slots in the first case and the second case to guide the first rotation protrusion such that the catcher moves in the front and rear direction, and a guide rail configured to guide the second guide protrusion.

14. The refrigerator of claim 13, wherein the guide rail includes a first guide rail configured to guide the locking member to move linearly in the front and rear direction, and a second guide rail configured to guide the locking member to rotate about the second rotation protrusion.

15. The refrigerator of claim 14, wherein the second case includes a first guide groove formed to guide the contact portion of the first rack gear to move in the front and rear direction, a second guide groove formed to guide the locking member to move in the front and rear direction, and a second guide slot formed to guide the first guide protrusion to rotate about the first rotation protrusion.

* * * * *